US006502343B2

(12) United States Patent
Cheng

(10) Patent No.: US 6,502,343 B2
(45) Date of Patent: Jan. 7, 2003

(54) EMERGENCY RESCUE DEVICE

(75) Inventor: Joung Young Cheng, 2F., No. 18, Lane 147, Fu Hwa Road, Shi Lin Suburb (TW)

(73) Assignees: Joung Young Cheng, Shi Lin Suburb (TW); Pin-Chi Cheng, Taipei (TW)

( * ) Notice: Subject to any disclaimer, the term of this patent is extended or adjusted under 35 U.S.C. 154(b) by 0 days.

(21) Appl. No.: 09/820,720

(22) Filed: Mar. 30, 2001

(65) Prior Publication Data

US 2002/0139029 A1 Oct. 3, 2002

(51) Int. Cl.[7] ..... F42B 4/22; F42B 4/24; F42B 4/26

(52) U.S. Cl. ..... 42/1.15; 102/205; 102/336; 102/338; 102/342; 102/345

(58) Field of Search ..... 42/1.15; 102/205, 102/336, 338, 342, 345

(56) References Cited

U.S. PATENT DOCUMENTS 3,319,596 A * 5/1967 Walter ..... 116/63 R
3,336,870 A * 8/1967 Gunyan et al. ..... 102/342
3,350,783 A * 11/1967 Whitehead ..... 33/228
3,432,857 A * 3/1969 Rasmussen et al. ..... 102/505
3,752,082 A * 8/1973 Kernan ..... 102/342
3,921,325 A * 11/1975 Tennigkeit ..... 42/1.15
4,266,357 A * 5/1981 Greenleaf ..... 42/1.15
4,592,159 A * 6/1986 Diederichs, Jr. ..... 42/1.15

* cited by examiner

*Primary Examiner*—Charles T. Jordan
*Assistant Examiner*—Tara M. Golba
(74) *Attorney, Agent, or Firm*—Shoemaker and Mattare

(57) ABSTRACT

An emergency rescue device is provided which includes a plurality of launching tubes, a plurality of upper and lower fixing pieces, a plurality of upper and lower connecting moving pieces, a plurality of groups of tenons and spring units, a lighting device, a plurality of supporting poles, a plurality of upper and lower uniting pieces, a plurality of upper and lower spring holder portions, an outer cylinder and a lid, etc. A flare used in the emergency rescue device comprises a far upper end loaded with signal powders; a second section loaded with pushing powders, below which lighting powders are loaded and are partially exposed to outside the circumference of the flare body; and a far lower end with a tail wing. The emergency rescue device of the present invention allows the flare to be fired immediately and consecutively at the sky for SOS signaling, enabling an immediate rescue for victims.

21 Claims, 6 Drawing Sheets

EMERGENCY RESCUE DEVICE

BACKGROUND OF THE INVENTION

The present invention relates to emergency rescue devices, and more particularly to an emergency rescue device that can send rescue signals up to the sky in case of urgent condition.

Nowadays major crimes that endanger people's life and property, such as killing, robbery, kidnapping and theft, take place quite often. One of the reasons why cases cannot be solved and criminals cannot be deterred in a timely manner is that the victim or the eyewitness fails to report cases to the police in time; thus the criminal who runs away at ease cannot be subdued in time and remains at large.

In addition, it has been commonly reported for the cases of individuals lost in adventuring mountains or rivers; however, rescue is delayed and casualties are caused for the lost individuals because they are not equipped with SOS-launching devices and fail to indicate the site to be rescued. On the contrary, if emergency rescue equipment is available, e.g. emergency rescue devices available for the individuals mentioned above to indicate their locations by firing the emergency rescue device, rescuers can reach them promptly, and thereby the extent of casualties can be reduced.

SUMMARY OF THE INVENTION

The objective of the present invention is to provide an emergency rescue device with flare to be fired immediately and consecutively at the sky for help.

The emergency rescue device of the invention includes the following components.

A plurality of launching tubes are each provided on its wall with a slide groove longitudinally, wherein a large opening as a friction-lighting opening is formed around the central portion of the groove, and each tube can be loaded therein with flares.

An upper fixing piece and a lower fixing piece are respectively provided at the upper and lower ends of the annularly-arranged launching tubes which distribute uniformly through the upper and lower fixing pieces; the tubes are fastened to the upper and lower pieces where they are placed throughwith, wherein the friction-lighting openings of the plurality of launching tubes face the outer edges of the upper and lower fixing pieces, wherein a through hole is in the center of each of the upper and lower fixing pieces.

At proper positions on the periphery of the upper and lower fixing pieces, indented hooks are formed at equally-distant intervals with a same quantity as that of launching tubes; wherein the indented hooks on the upper fixing piece are symmetrical to those on the lower fixing pieces.

An upper connecting moving piece is located above the upper fixing piece, and a lower connecting piece is located under the lower fixing piece; wherein the upper and lower connecting moving pieces appear to be analogous to a vertical view of the right hand with the thumb being positioned separately from the other four fingers aligned closely to each other, the palm facing the chest, and the thumb and the index finger being in a horizontal position; wherein a through hole is provided on the upper and lower connecting moving pieces respectively at a position corresponding to the fingertip of the thumb, wherein the through hole corresponding to the upper thumb and that of the lower thumb are correspondingly aligned with those in the centers of the upper and lower fixing pieces; a through hole is provided at a position corresponding to the fingertip of the index finger, and a through hole is provided at a position corresponding to the wrist on the upper and lower connecting moving pieces, respectively, wherein the through hole corresponding to the upper index finger is aligned with that corresponding to the lower index finger, whereas the through hole corresponding to the upper wrist is also aligned with that corresponding to the lower wrist; wherein a bullet feeding opening, provided on the upper connecting moving piece, corresponds to an opening of the launching tube, which allows each flare to be placed therein with respect to an indented portion, which also acts as the outlet for launching a flare wherein an opening is provided on the lower connecting moving piece corresponding to the bullet feeding opening on the upper connecting moving piece, wherein an indented portion of the lower connecting moving piece allows the tail flame to go through when the flare is launched; the upper connecting moving piece is provided with a group of upper screw holes and an upper spring fixing end protruding upwardly around the position corresponding to the end of the upper wrist; wherein the lower connecting moving piece is provided with a group of lower screw holes and lower spring fixing end protruding downwardly around the position corresponding to the end of the lower wrist wherein the upper screw holes and the lower screw holes are symmetrical in position, and the upper spring fixing end and the lower spring fixing end are also symmetrical in position.

A first tenon and a first spring are provided, wherein an appropriate hole from the group of the upper screw holes may be chosen and used to fasten the first tenon and the first spring wherein one end of the first spring is fixed on the upper connecting moving piece while the other end is pressed and fixed on the first tenon, allowing the first tenon to be hooked to the indented hook of the upper fixing piece.

A second tenon and a second spring are provided, wherein an appropriate hold from the group of the upper screw holes may be chosen and used to fasten the second tenon and the second spring, wherein one end of the second spring is fixed on the lower connecting moving piece while the other end is pressed and fixed on the second tenon, allowing the second tenon to be hooked to the indented hook of the lower fixing piece.

A lighting device is formed of an arc shaped pulling handle and a friction piece; wherein the friction piece is placed inside the pulling handle with its indented side facing the friction lighting opening; wherein the pulling handle is provided at its one end with a sleeve tab, its radial direction protruding outward. The friction piece is provided at its one end with a fixing tube aiming at the pair of through holes at the one end of the pulling handle, wherein the through hole corresponding to the upper index finger, the pair of through holes aiming at the sleeve tube, the sleeve tube and the through hole corresponding to the lower index finger are aligned; wherein the pair of through holes at the other end of the pulling handle, the through hole corresponding to the upper wrist and the through hole corresponding to the lower wrist are also aligned; wherein a metal convex mesh portion is provided on the surface of the friction piece facing the friction lighting opening.

A first supporting pole passes through the through hole corresponding to the upper index finger, the pair of through holes aiming at the sleeve tube, and the through hole corresponding to the lower index finger; wherein after both ends of the first supporting pole pass through the through holes corresponding to the upper index finger and the lower index finger, both ends are fastened.

A second supporting pole passes through the pair of through holes at the other end of the pulling handle, the through hole corresponding to the upper wrist and the through hole corresponding to the lower wrist; wherein after both ends of the second supporting pole pass the through holes corresponding to the upper wrist and the lower wrist, both ends are fastened.

An upper uniting piece is located above the upper connecting moving piece, wherein in the center of the upper uniting piece is provided with a through hole corresponding to that of the center of the upper fixing piece; wherein the upper uniting piece is provided with launching openings in the same quantity as that of launching tubes, and solid openings correspond to the launching openings of the plurality of launching tubes on the upper fixing piece; wherein at an appropriate position on the upper uniting piece where the sliding of the upper connecting moving piece cannot reach, a stand for a group of upper screw holes is provided with a thickness approximately equal to that of the upper connecting moving piece; wherein an upper recessed arc portion is left on the upper uniting piece allowing the upper spring fixing end to protrude from the upper uniting piece and move thereby with the upper concaved annular portion; wherein other than the upper concaved annular portion, the rest of the periphery of the uniting piece is provided with a screw hole portion for mounting screws.

A lower uniting piece is located under the lower connecting moving piece; wherein at the center of the lower uniting piece a through hole is provided, corresponding to the central through hole of the lower fixing piece; wherein there is a hole on the lower uniting piece with a diameter a little shorter than that of the launching opening of the launching tube, allowing the tail flame to pass through when the flare is launched; wherein at an appropriate position on the lower uniting piece where the sliding of the lower connecting moving piece cannot reach, a stand for a group of lower screw holes is provided with a thickness approximately equal to that of the lower connecting moving piece; wherein a lower concaved annular portion is left on the lower uniting piece, allowing the lower spring fixing end to protrude from the lower uniting piece and move thereby within about in the lower concaved annular portion; wherein other than the concaved annular portion, the rest of the periphery of the lower uniting piece is provided with a screw hole portion for mounting screws.

An upper spring holder portion has the shorter wire end of its spring coil fixed on the upper uniting piece and the longer wire end hooked to the spring fixing end that protrudes from the upper uniting piece.

A lower spring holder portion has the shorter wire end of its spring coil fixed on the lower uniting piece and the longer wire end hooked to the spring fixing end that protrudes from the lower uniting piece.

A third supporting pole passes through the spring coil of the upper spring holder portion, the central through hole of the upper uniting piece, the through hole corresponding to the thumb of the upper connecting moving piece, the central through hole of the upper fixing piece, the central through hole of the lower fixing piece, the through hole corresponding to the thumb of the lower connecting moving piece, and the central through hole of the lower uniting piece and the spring of the lower spring holder portion, wherein after each of the both ends of the third supporting pole is fastened, the assembly of the inner body is completed.

An outer cylinder is provided. The inner body combined by the third pole is placed in the outer cylinder and fastened the outer cylinder at the peripheral edges of the upper uniting piece and the lower uniting piece.

A lid closing and fastened on the end of outer cylinder near the upper uniting piece, on which a launching opening is provided correspondingly to the opening of launching tube for launching flare.

The flare used in the emergency rescue device of the invention comprises:

Far upper end with signaling powders; a second section loaded with pushing powders, below which lighting powders are loaded and are partially exposed to outside the circumference body; and a far lower end with a tail wing. When the flare is placed into the launching tube, the height of the lighting powder in the launching tube is the same as that in the metal convex mesh portion. When the metal convex mesh portion turns, it can rub the lighting powder.

The emergency rescue device of the invention is provided with several launching tubes therein; each tube contains one flare. When in use, it is only necessary to hold the said device securely with two hands, face the launching mouth upward, hold the supporting member with the index finger of the right hand (or harness the supporting member on the four fingers when using one single hand), and hold and press the pulling tab forward with the thumb allowing it to slide to a preset position, at this point a flare can be immediately launched. The pulling tab will automatically return to its original position when the thumb releases it. Meanwhile the launching tubes annularly arranged in the launching device move back in sequence, and the next launching tube with a flare therein is now placed at the launching position. To launch again, similarly, hold the supporting member with the index finger of the right hand, and hold and press the pulling ear forward with the thumb, allowing it to slide to a preset position, and then another flare can be launched. This can be done continuously until all the flares in the launching device are launched. When the flares in the launching device are all launched, the lid can be taken off and the flares can be reloaded again into each launching tube.

BRIEF DESCRIPTION OF THE DRAWINGS

The objectives and the advantages of the invention will be clear from the following detailed description with reference to the accompanying self-explanatory drawings—reference numbers in each drawing represent the corresponding parts—wherein.

DETAILED DESCRIPTION OF THE PREFERRED EMBODIMENTS

Figure 1:
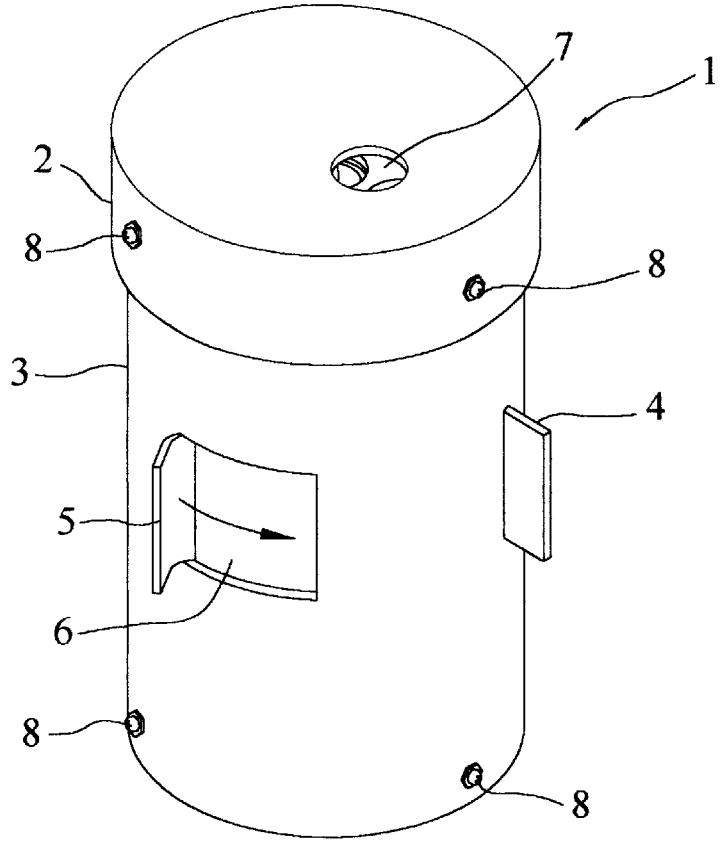
FIG. 1 is a schematic stereogram showing an embodiment of the structure of the emergency rescue device of the invention.
Figure 2:
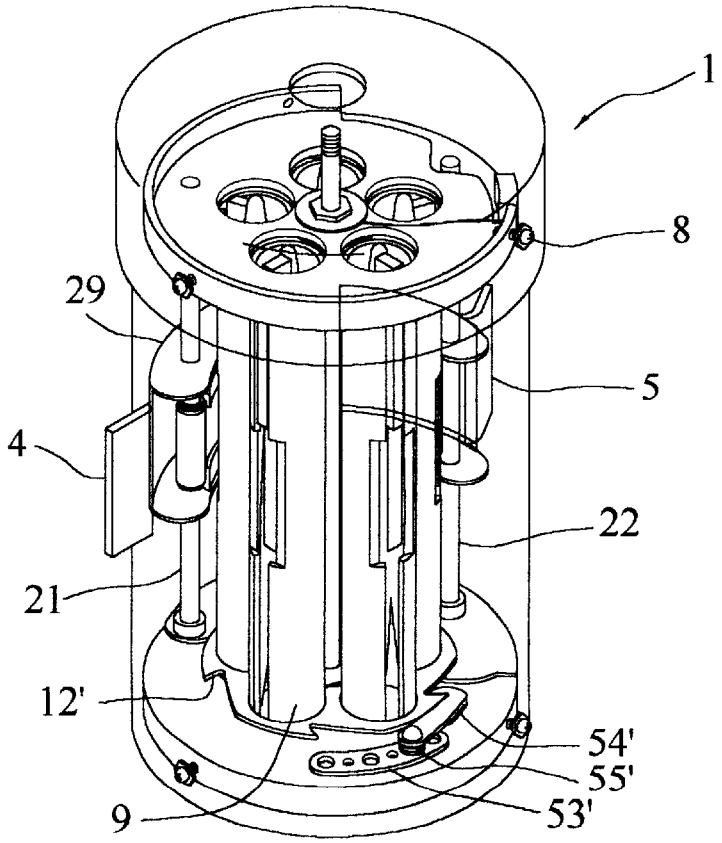
FIG. 2 is a schematic perspective stereogram of the embodiment in FIG. 1.

First, with reference to the schematic stereogram of FIG. 1 showing an embodiment of the structure of the schematic stereogram launching device 1 of the emergency and the perspective stereogram of FIG. 2, which is a perspective view of FIG. 1 with the hexagon screws 8 on the outer cylinder 3 and the lid 2 of the launching device 1 of the emergency rescue device being dismounted and the outer cylinder 3, and the lid 2 being removed. In FIG. 1, number 4 represents the supporting member vertically fixed on the outer cylinder 3. In FIG. 1, number 5 is the pulling tab of the pulling handle 29; number 6 is an opening of the space allowing the pulling tab to move; number 7 is the launching opening. In FIG. 2, the launching tube 9, the indented hook 12', the supporting poles 21 and 22, the screw holes' stand 53', the tenon 54' and spring 55', as well as the rest of the inner structure shown, will be described in details later.

Figure 3:
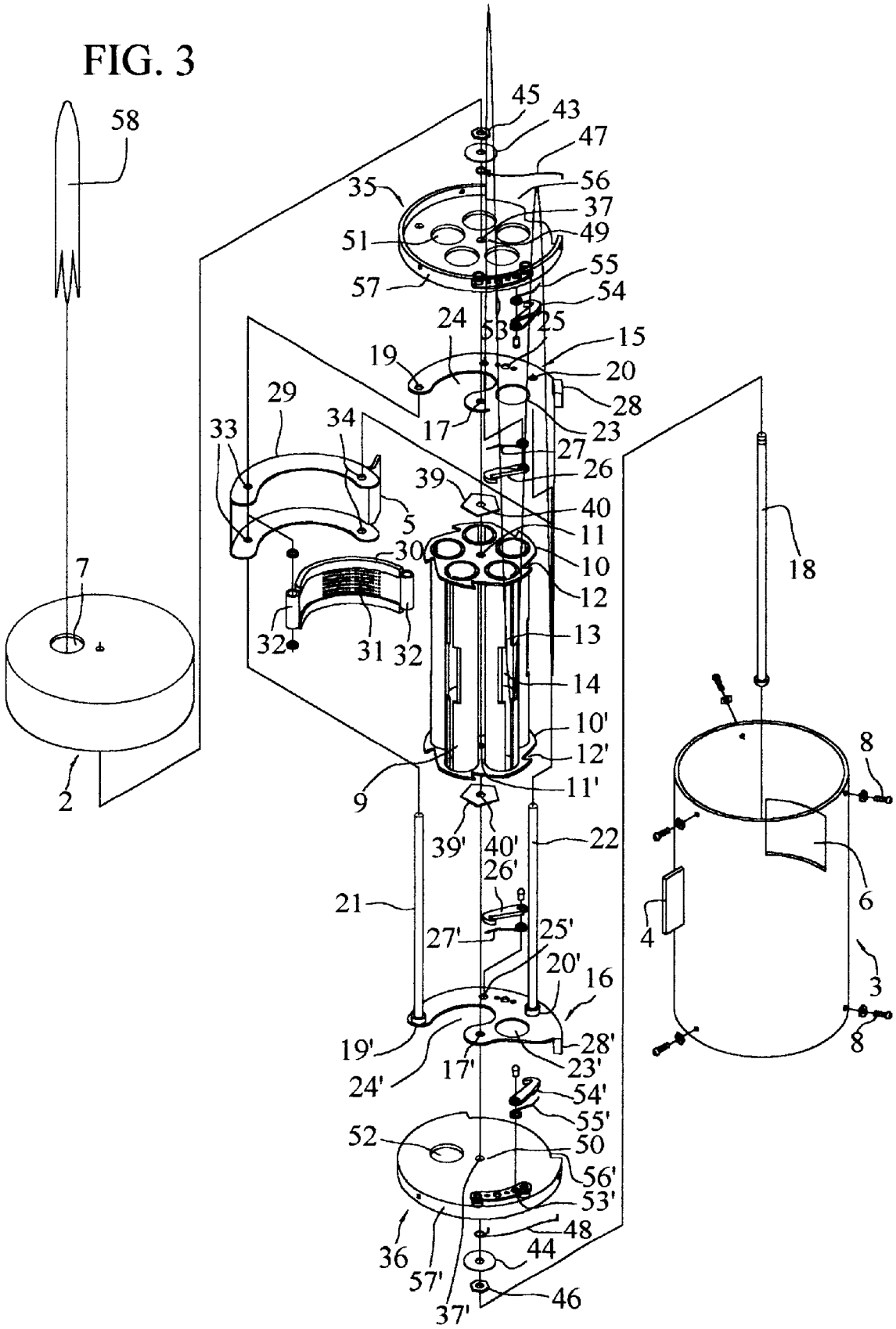
FIG. 3 is a schematic dissecting diagram of the embodiment in FIG. 1.

Please refer to the dissected view in FIG. 3 for the structure of the embodiment. A plurality of launching tubes 9 (there are five tubes in this embodiment) are annularly disposed at equal intervals; the five launching tubes are secured by one end of the launching tube 9 passing through the upper fixing piece 10 while the other end passes through the lower fixing piece 10', so as to secure the 5 launching tubes. A reinforcing piece (not shown) can also be used certainly to further secure the five launching tubes. Where each launching tube faces the outer edges of the upper fixing piece 10 and the lower fixing piece 10', the tube is provided with a slide groove 13 (for reducing friction and guiding direction) in a vertical direction on the wall surface thereof. A section of a larger opening, formed around the central portion of the slide groove 13, is called the friction lighting opening 14. The friction lighting opening 14 of each launching tube positions at the same height, so as to facilitate a correct lighting of the flare in each launching tube. There are through holes 11, 11' in the center of the upper and lower fixing pieces 10, 10'. On the periphery of the upper and lower fixing pieces 10, 10', indented hooks 12, 12' are formed at an appropriate position between every two neighboring launching tubes. The upper and lower fixing pieces have 5 indented hooks 12, 12' on their periphery respectively. Also, the indented hooks 12 on the upper fixing piece are symmetrical to the indented hooks 12' on the lower fixing piece.

The upper connecting moving piece 15 is located above the upper fixing piece 10, while the lower connecting moving piece 16 is located under the lower fixing piece 10'. The upper and lower connecting moving pieces 15, 16 appear to be analogous to a vertical view of the right hand with the thumb being positioned separately from the other four fingers aligned closely to each other, the palm facing the chest, and the thumb and the index finger being in a horizontal position. A through hole 17 is provided on the upper connecting moving piece 15 at the position corresponding to the thumb fingertip; a through hole 17' is provided on the lower connecting moving piece 16 at the position corresponding to the thumb fingertip. The through holes 17, 17', the through holes 11, 11' on the upper and lower fixing pieces 10, 10', the central through hole 40 of the pentagonal washer 39 between the upper connecting moving piece 15 and the upper fixing piece 10, and the central through hole 40' of the pentagonal washer 39' between the lower connecting moving piece 16 and the lower fixing piece 10' are correspondingly aligned, allowing the supporting pole 18 to pass through. A through hole 19 is provided on the upper connecting moving piece 15 at the position corresponding to the index finger; a through hole 20 at the position corresponding to the wrist. A through hole 19' is provided on the lower connecting moving piece 16 at the position corresponding to the fingertip of the index finger; a through hole 20' at the position corresponding to the wrist. While the through holes 19, 19' allow the supporting pole 21 to pass through, the through holes 20, 20' allow the supporting pole 22 to pass through. The upper connecting moving piece 15 is provided with a bullet feeding opening 23 corresponding to the entry of a launching tube 9, allowing each flare to be placed continuously into each launching tube 9 in association with a recessed portion 24.

The recessed portion 24 is also the exit for flare when it is launched. An opening 23' on the lower connecting moving piece 16 corresponds to the bullet feeding opening 23 on the upper connecting moving piece 15, allowing the flare placed into the launching tube 9 from the bullet feeding opening 23 to be at the same height as the other flares in the other launching tubes for easy lighting. The recessed portion 24' on the lower connecting moving piece 16 allows the tail flame to pass when the flare is launched. A group of screw holes 25 is on the upper connecting moving piece 15, and an appropriate screw hole can be chosen to fasten the tenon 26 and spring 27 thereof. One end of the spring 27 is inserted in the upper screw holes' group 25 of the upper connecting moving piece 15 and the other end is suppressed on the tenon 26, allowing the tenon 26 to be elastically hooked to the indented hook 12 of the upper fixing piece 10. A group of screw holes 25' is on the lower connecting moving piece 16 and an appropriate screw hole can be chosen to fasten the tenon 26' and the spring 27' in coordination with a screw hole chosen from screw holes' group 25. One end of the spring 27' is inserted in the upper screw holes' group 25' of the lower connecting moving piece 16 while the other end is suppressed on tenon 26', thus allowing the tenon 26' to be elastically hooked to the indented hook 12' of the lower fixing piece 10'. The upper connecting moving piece 15 is provided with a spring fixing end 28 protruding upward around the position corresponding to the end of the wrist; the lower connecting moving piece 16 is provided with a spring fixing end 28' protruding downward around the position corresponding to end of the wrist.

At the position facing the friction lighting opening 14 of the launching tube 9, a lighting device is provided, which is formed of a pulling handle 29 and a friction piece 30. Both pulling handle 29 and friction piece 30 are in an arc shape with the recessed side facing the friction lighting opening 14. Inside the pulling handle 29 is placed the friction piece 30, at least one end of which is provided with a sleeve tube. The pair of the through holes 33 of the sleeve tube 32 aiming at the end of pulling handle 29 without pulling tab 5 allows the supporting pole 21 to pass simultaneously through the through hole 19, the pair of through holes 33, the sleeve tube 32 and the through hole 19'. When both ends of the supporting pole 21 pass the through hole 19 and through hole 19', they are fastened. Meanwhile, the pair of the through holes 34 at the end of the pulling handle 29 with pulling tab 5 allows the supporting pole 22 to pass simultaneously the through hole 20, the pair of through holes 34 and through hole 20'. When the both ends of the supporting pole 22 pass through the through hole 20 and the through hole 20', they are fastened. Thus, the upper connecting moving piece 15, the lower connecting moving piece 16 and the lighting device (including the pulling handle 29, the friction piece 30) are combined together. On the surface of the friction piece 30 facing the friction lighting opening 14, a metal convex mesh 31 is provided. When the user uses the thumb to press the pulling tab 5 to slide forward, it makes the metal convex mesh rub the lighting powder 61 of the flare 58 (refer to FIG. 4), and the flare is lighted. Certainly, the width of the friction piece 30 allows the sliding to rub only the lighting powder of the flare to be launched, but not the lighting powder of the flare in the neighboring launching tube 9.

The upper uniting piece 35 is located above the upper connecting moving piece 15, with a through hole 37 provided in the center of the upper uniting piece 35. The lower uniting piece 36 is located under the lower connecting moving piece 16, with a through hole 37' provided in the center of the lower uniting piece 36. The supporting pole 18 passes through the central through hole 37 of the upper uniting piece 35, the through hole 17 of the upper connecting piece 15, the central through hole 40 of the pentagonal washer 39, the central through hole 11 of the upper fixing piece 10, the central through hole 11' of the lower fixing piece 10', the central through hole 40' of the pentagonal washer 39', the through hole 17' of the lower connecting moving piece 16 and the central through hole 37' of the lower uniting piece 36. After the both ends of the supporting pole 18 pass through the central through hole 37 of the upper uniting piece 35 and the central through hole 37' of the lower uniting piece 36, said both ends again pass through the spring coils of the upper spring holder portion 47 and the lower spring holder portion 48 respectively and are fastened using washers 43, 44 and the nuts 45, 46 respectively. Thus, the inner components of the emergency rescue device 1 are all assembled together.

The upper uniting piece 35 is provided with 5 launching openings 51, respectively corresponding to the launching openings of the 5 launching tubes 9 on the upper fixing piece 10; the diameter of the launching opening 51 is a little larger than that of the launching opening of the launching tube 9. A hole 52 is provided on the lower uniting piece 36, allowing the tail flame to pass through when the flare 58 is launched; the diameter of the hole 52 is a little smaller than that of the launching opening of the launching tube 9. Thus, when the flare is placed into the launching tube 9 corresponding to the hole 52, the flare will not slip out from the hole 52. When the pulling tab 5 is pushed to slide forward, an appropriate position on the upper uniting piece 35 where the sliding of the connecting moving piece 15 cannot reach is provided with a screw holes' stand 53. The thickness of the screw holes' stand 53 is approximately equal to that of the upper connecting moving piece 15. A plurality of screw holes is provided on the screw holes' stand 53, and an appropriate screw hole can be chosen and used to mount the tenon 54 and the spring 55. One end of the spring 55 is inserted in the screw hole of the screw holes' stand 53 while the other end is pressed on the tenon 54, thus allowing the tenon 54 to be elastically hooked to the indented hook 12 of the fixing piece 10. Similarly, an appropriate position on the lower uniting piece 36 where the sliding of the connecting piece 16 cannot reach is provided with a screw holes' stand 53'. The thickness of the screw holes' stand 53' is approximately equal to that of the lower connecting moving piece 16. A plurality of screw holes is provided on the screw holes' stand 53', and an appropriate screw hole can be chosen and used to mount the tenon 54' and the spring 55'. One end of the spring 55' is inserted in the screw hole of the screw holes' stand 53' while the other end is pressed on the tenon 54', thus allowing the tenon 54' to be elastically hooked to the indented hook 12' of the lower fixing piece 10'.

The shorter wire ends of the upper spring holder portion 47 and the lower spring holder portion 48 are respectively inserted in the small holes 49, 50 beside the central through holes of the upper uniting piece 35 and the lower uniting piece 36; whereas the other longer wire ends are respectively hooked to the spring fixing end 28 of the upper connecting moving piece 15 and the spring fixing end 28' of the lower connecting moving piece 16. Thus, after the pulling tab 5 of the pulling handle 29 is pushed to slide forward and rubbed to launch a flare, the upper connecting moving piece 15, the lower connecting moving piece 16 and the lighting device, including the pulling handle 29 and friction piece 30, can be brought back to their original positions by means of the elasticity of the upper spring holder portion 47 and the lower spring holder portion 48, if the pulling tab 5 is released. At this moment, also because the tenons 26, 26' of the upper connecting moving piece 15 and the lower connecting moving piece 16 are respectively hooked to the indented hooks 12, 12' of the upper and lower fixing pieces 10, 10', 5 launching tubes 9 may be brought backward and the next launching tube 9 brought to a launching position. When the next launching tube 9 is brought to the launching position, the tenons 54, 54' on the upper uniting piece 35 and the lower uniting piece 36 are again hooked respectively to the indented hooks 12, 12' of the upper and lower fixing pieces 10, 10'.

The longer wire ends of the upper spring holder portion 47 and the lower spring holder portion 48 are respectively hung on the spring fixing end 28 of the upper connecting moving piece 15, and the spring fixing end 28' of the lower connecting moving piece 16. In order to enable the upper connecting moving piece 15 with the spring fixing end 28 on it, and the lower connecting moving piece 16 with the spring fixing end 28' on it, to turn together when the user pushes the pulling tab 5 with the thumb to slide it forward, the recessed arc portions 56, 56' positioned symmetrically up and down are left respectively on the upper uniting piece 35 and the lower uniting piece 36, allowing the spring fixing ends 28, 28' to protrude respectively on the upper uniting piece 35 and the lower uniting piece 36 so as to hang the longer wire ends of the upper spring holder portion 47 and the lower spring holder portion 48. When the pulling tab 5 slides forward or retreats, the spring fixing ends 28, 28' can move around respectively within the recessed annular portion 56, 56'.

Figure 6:
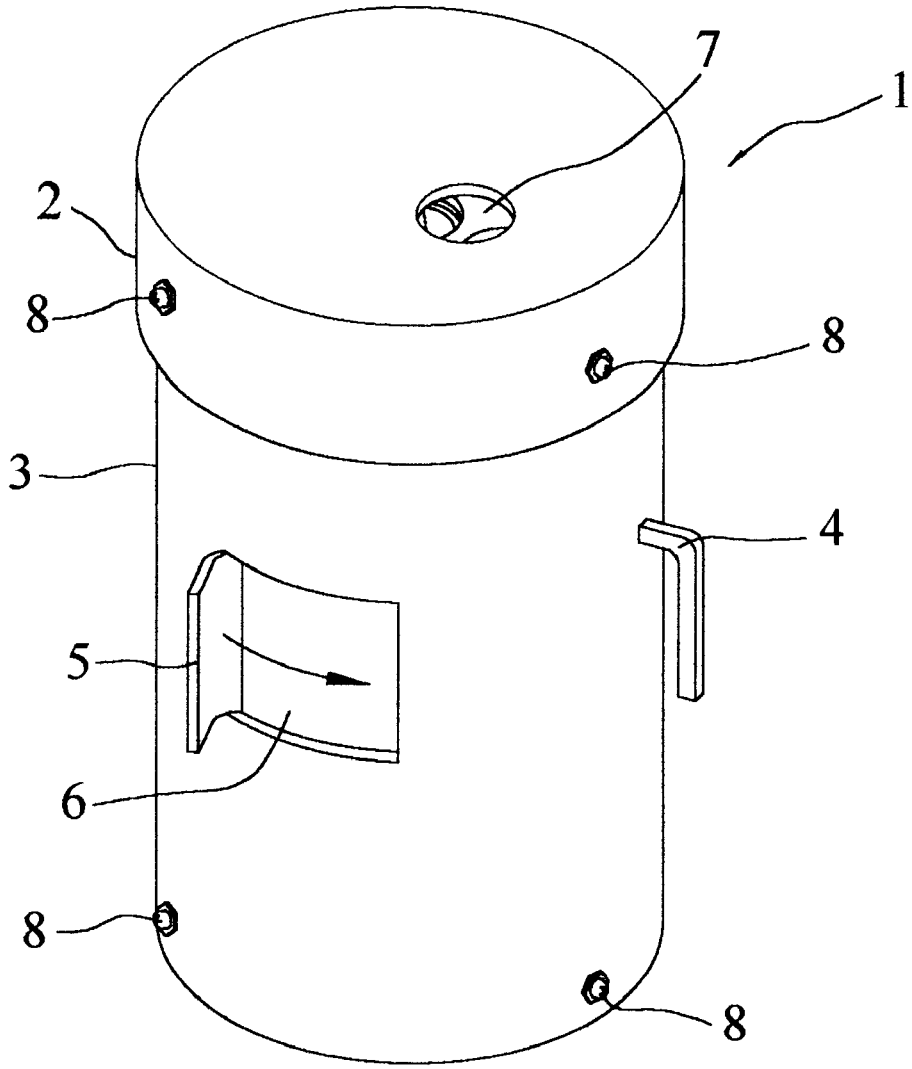
FIG. 6 is a schematic diagram of another embodiment of the invention having different designs for the supporting member.

Besides the recessed annular portions 56, 56' on the periphery of the upper uniting piece 35 and lower uniting piece 36, the rest portions are provided with short extended rims 57, 57' respectively protruding upward and downward; there are screw holes on the short extended rims 57, 57'. After the body is mounted with the outer cylinder 3 and covered by the lid 2, hexagonal screws 8 are used to fasten the screw holes, and the assembly of the emergency rescue device 1 of the invention is accomplished. The outer cylinder 3 is provided thereon with a supporting member 4 and an opening 6 for a space allowing the pulling tab 5 to protrude. When using both hands to securely hold the emergency rescue device 1, the launching opening is kept facing upwards, supporting member 4 is held with the index finger of the right hand, and the pulling tab 5 is pressed forward with the thumb enabling the pulling tab 5 to slide within the space of the opening 6 to a preset position; thus the flare can be launched. The outer cylinder 3 may be formed of two semi-cylinders, and one of the semi-cylinders is provided with an opening 6, allowing the pulling tab 5 to protrude. The lid 2 closes the end on the outer cylinder 3 near the upper uniting piece 35, on which a launching opening 7 is provided corresponding to the opening of the launching tube for launching flare. The diameter of the launching opening 7 should be a little larger than that of the opening of the launching tube of the launching cylinder and that of the bullet feeding opening 23 of the upper connecting moving piece 15. The short extended rims 57, 57' can be modified to form a short square extended rim only at the place where the screw is fastened, at which screw holes are provided. The supporting member 4 of the outer cylinder 3 may be designed to form a handle shape 4 as shown in FIG. 6. Thus, the emergency rescue device 1 can be held with one single hand by holding the supporting member 4' with the other four fingers of the right hand, and the pulling tab 5 is pressed with the thumb to slide to the preset position to launch the flare. At this point, the Emergency rescue device 1 is secured and will not drop to the ground.

Figure 4:
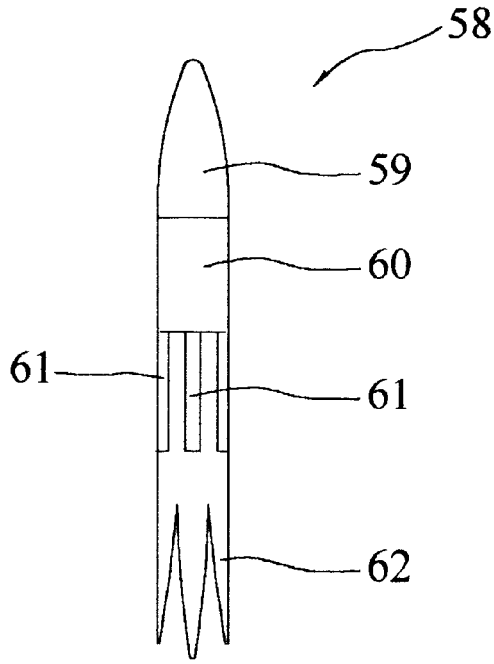
FIG. 4 is a schematic diagram of the structure of the flare used in FIG. 1.

FIG. 4 illustrates the structure of the flare 58 used in the embodiment. The signaling powder 59 is loaded at the far upper end of the flare 58, the pushing powder 60 is loaded in the middle and the lighting powder 61 is loaded below the pushing powder 60 and is exposed to the outside. The lighting powder 61 in the launching tube 9 is right in the same height as the metal convex mesh 31, so that the turning of the metal convex mesh 31 can rub the lighting powder 61 to light the flare 58. The lighting powder 61 can be provided only at the one location on the periphery of the flare for directionality. When the flare is loaded into the launching tube 9, the lighting powder 61 is required to face the direction to the metal convex mesh 31. The flare 58 is provided with a tail wing 62 at its far lower end to help stabilize the launching direction of the flare 58.

Figure 5A:
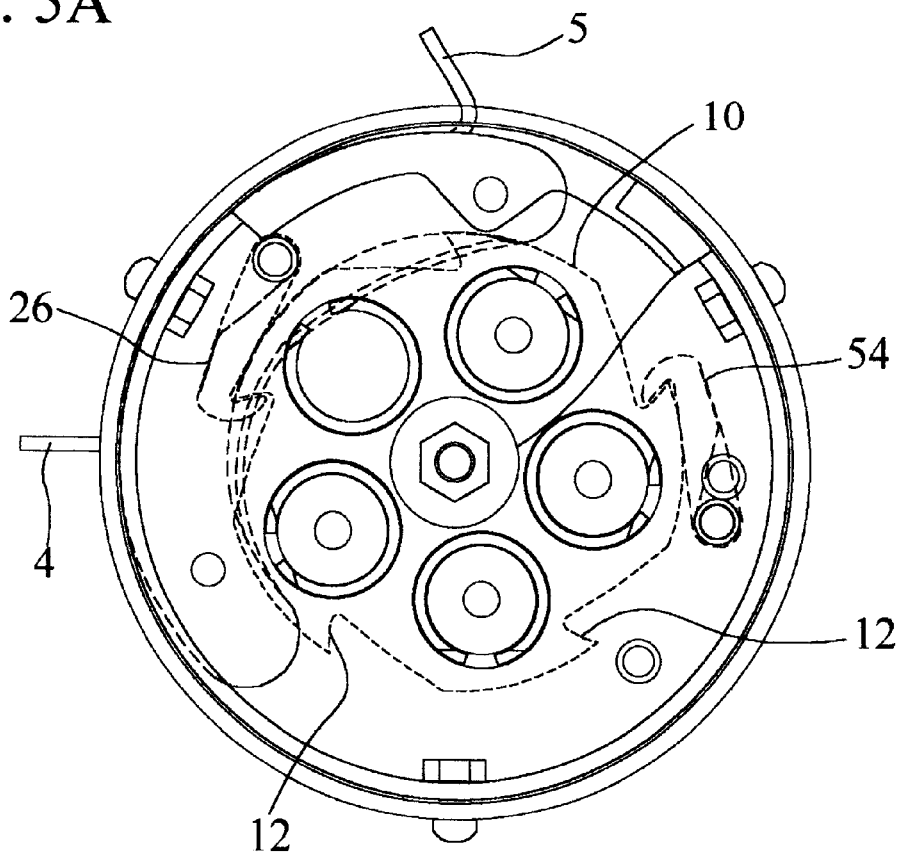
FIGS. 5A–5E are vertical views showing positional variations of processes for launching the flares by pulling the pulling handle in the embodiment of FIG. 1.
Figure 5B:
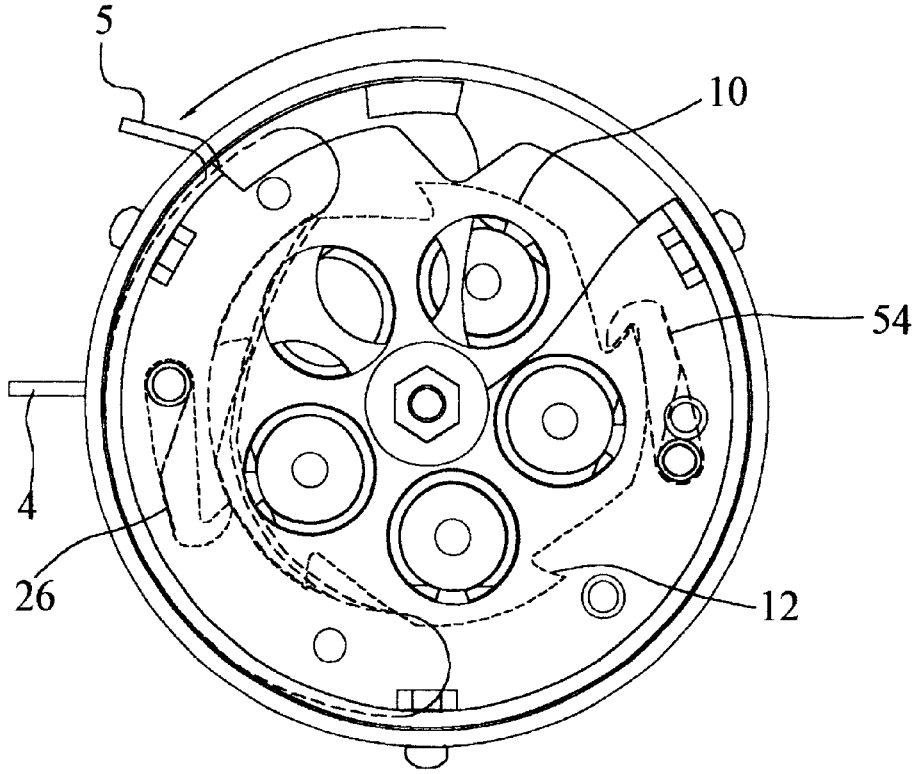

The operational of the emergency rescue device of the invention to launch flares may be described with reference to the prior FIG. 3 in conjunction with FIG. 5A to FIG. 5E. FIG. 5A to FIG. 5E only shows the situation of the tenon 26 on the upper connecting moving piece 15 and the tenon 54 on the upper uniting piece 35 hooked to the recessed groove 12 on the upper fixing piece 10, as well as that of the tenon 26' on the lower connecting moving piece 16 and the tenon 54' on the lower uniting piece hooked to the recessed groove 12' on the lower fixing piece 10'. When the 5 launching tubes of the emergency rescue device 1 are all loaded with flares (or at least the launching tube facing the metal convex mesh 31 loaded with flare 58), both hands are used to securely hold the emergency rescue device 1 for launching flares. The launching opening is kept facing up, the supporting member 4 is held with the index finger of the right hand (refer to FIG. 1), and the pulling tab 5 is pressed with the thumb allowing the pulling tab 5 to slide forward within the space of the opening 6 to the end of the opening 6. At this point, the flare 58 in the launching tube corresponding to the metal convex mesh 31 can be launched. When the pulling tab 5 is not pressed by the thumb before launching, as show in FIG. 5A, the tenon 26 on the upper connecting moving piece 15 is hooked to the recessed groove 12 on the fixing piece 10 and the tenon 54 on the upper uniting piece 35 is also hooked to the another recessed groove 12 on the fixing piece 10 (at the same time, similarly, the tenon 26' on the lower connecting moving piece 16 is hooked to the recessed groove 12' on the lower fixing piece 10', and the tenon 54' on the lower uniting piece 36 is also hooked to the another recessed groove 12' on the lower fixing piece 10'). After beginning to press the pulling tab 5, as shown in FIG. 5B, as the tenon 26 connects with the upper connecting moving piece 15 and lighting device, the tenon 26 will be carried away from the original recessed groove 12 to slide on the arc surface of the upper fixing piece 10 (refer to FIG. 5B). However, at this moment, the tenon 54, which connects with the upper uniting piece 35 and unites with the outer cylinder 3, cannot move but is tightly hooked to the recessed groove 12 of the upper fixing piece 10 (similarly at this moment the tenon 54' is also tightly hooked to the recessed groove 12' of the lower fixing piece 10'). Therefore, the upper and lower fixing pieces 10, 10' and the 5 launching tubes 9 cannot move. Thus, when the pulling tab 5 in the space of the opening 6 slides forward, the metal convex mesh 31 on the lighting device can slide over the lighting powder 61 on the flare 58, where the friction lights up the lighting powder 61, and the flare 58 is launched.

Figure 5C:
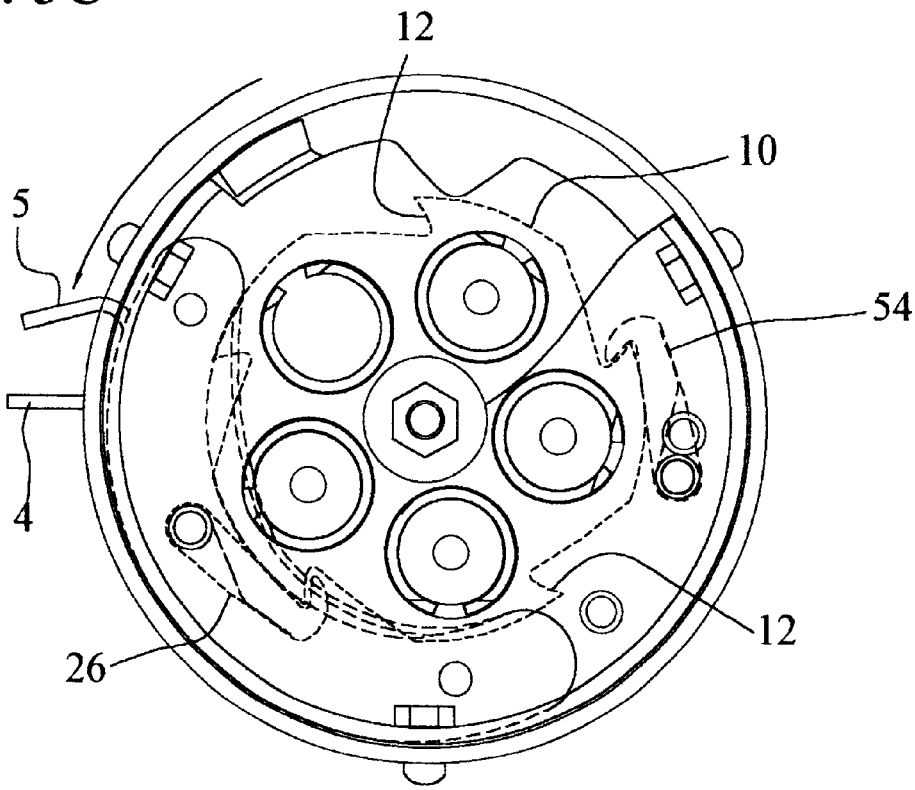
Figure 5D:
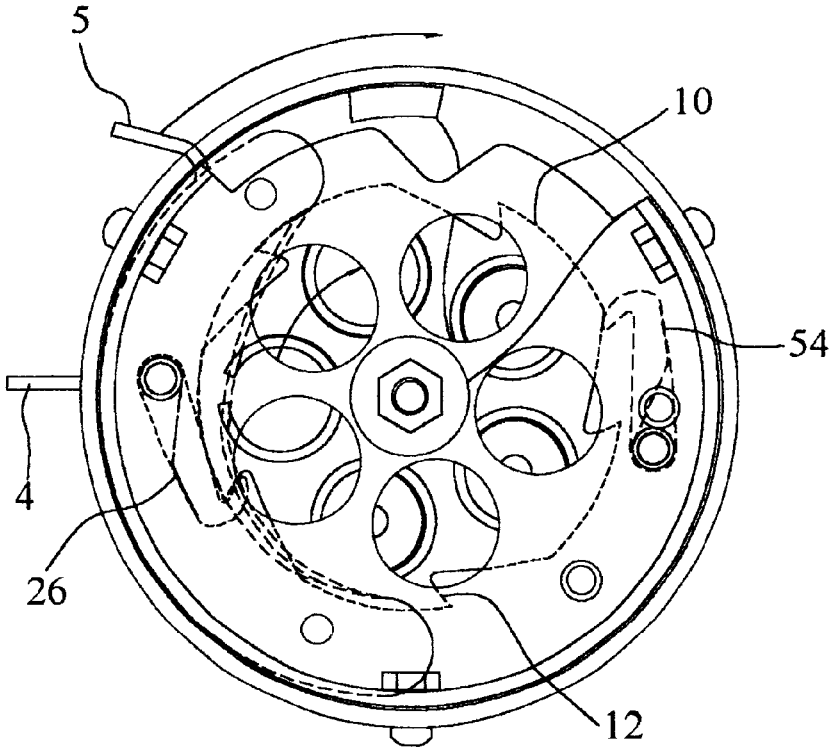
Figure 5E:
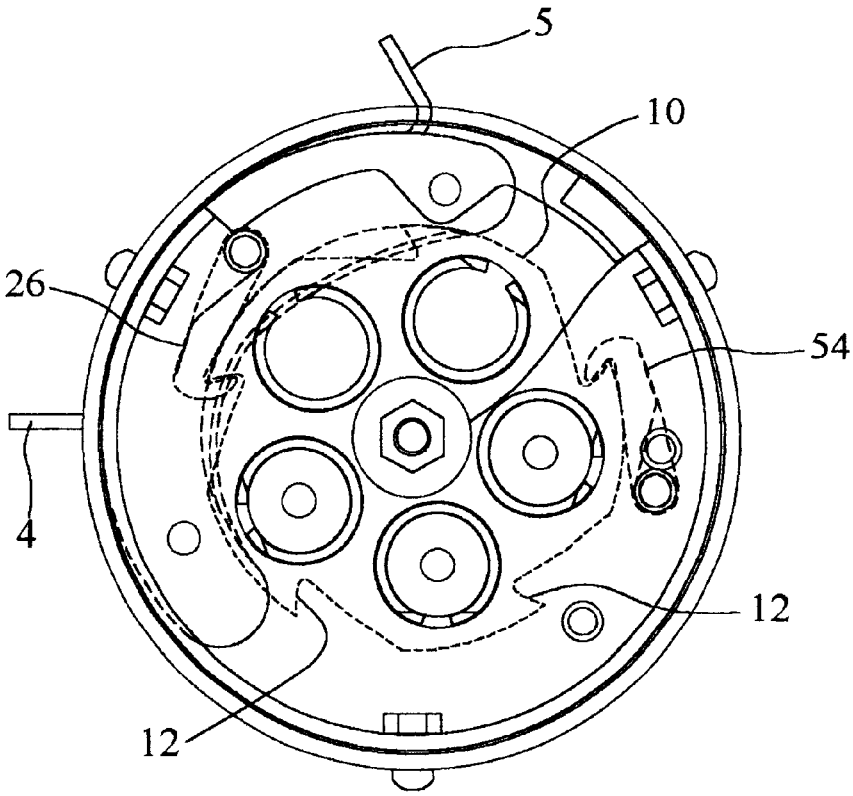

As shown in FIG. 5C, when the pulling tab 5 in the space of the opening 6 slides forward to the end of the opening 6, the tenon 26 is brought to the next recessed groove 12 and is hooked said recessed groove (the tenon 26' is brought to the next recessed groove 12' and hooked to it). In the process of pressing the pulling tab 5 to launch the flare, as the longer wire ends of the upper spring holder portion 47 and the lower spring holder portion 48 are respectively hooked to the spring fixing end 28 on the upper connecting moving piece 15 and the spring fixing end 28' of the lower connecting moving piece 16, the spring is tightly pulled. When the upper connecting moving piece 15 and the lower connecting moving piece 16 turn, the elasticity is stored. Therefore, after the flare 58 is launched, if the thumb releases from pressing pulling tab 5, the elasticity restored in the upper spring holder portion 47 and the lower spring holder portion 48 will carry the upper and lower connecting pieces 15, 16 and the lighting device back to their original places, as shown in FIG. 5D. At this point, as the tenons 26, 26' on the upper connecting moving piece 15 and the lower connecting moving piece 16 are hooked to the next recessed grooves 12, 12', so as to pull back and turn the upper and lower fixing pieces 10, 10' and 5 launching tubes together for an interval distance between launching tubes. That is, the next launching tube is pulled back to the opposite position facing the metal convex mesh 31 on the lighting device to stand by for the next launching. In the process of pulling back and turning the upper and lower fixing pieces 10, 10' and the 5 launching tubes, the tenons 54, 54' on the upper uniting piece 35 and the lower uniting piece 36 will slide on the arc surfaces as those of the upper and lower fixing pieces 10, 10' (refer to FIG. 5D). When the next launching tube reaches the preset launching position opposing the convex mesh 31, the tenons 54, 54' are just hooked to the next turn of recessed grooves 12, 12', as shown in FIG. 5E. Thus, one cycling motion of launching flares is completed.

Although the invention has been described by means of embodiments, it should be understood that any variations or modifications made without deviation from the broad spirit and aspects defined in the scope of what is claimed should be construed as included in the scope of the invention:

I claim:

1. An emergency rescue device comprising:

a plurality of launching tubes (9), with a friction lighting opening (14) being provided on a wall of each of the launching tubes (9);

an upper fixing piece (10) and a lower fixing piece (10') respectively provided at upper and lower ends of the launching tubes (9), wherein the launching tubes (9) are annularly arranged and distributed uniformly, and pass through the upper and lower fixing pieces (10, 10');

wherein the upper and lower fixing pieces (10, 10') are fastened together with the launching tubes (9) that pass through the upper and lower fixing pieces (10, 10'), with the friction lighting openings (14) of the launching tubes (9) facing outwardly;

wherein each of the upper and lower fixing pieces (10, 10') is provided with a centrally-situated through hole (11, 11') and peripherally formed at equal intervals with a number of recessed hooks (12, 12') equal to the number of the launching tubes (9);

an upper connecting moving piece (15) and a lower connecting moving piece (16), wherein the upper connecting moving piece (15) is located above the upper fixing piece (10), and the lower connecting moving piece (16) is located under the lower fixing piece (10');

wherein the upper and lower connecting moving pieces (15, 16) are each analogous to a horizontal view of a right hand with a thumb being separated from the other four fingers aligned closely together;

wherein the upper and lower connecting moving pieces (15, 16) are each provided with a first through hole (17) corresponding in position to a fingertip of the thumb, allowing the first through holes (17, 17') of the upper and the lower connecting moving pieces (15, 16) to be aligned respectively with the centrally-situated through holes (11, 11') of the upper and lower fixing pieces (10, 10');

wherein the upper and lower connecting moving pieces (15, 16) are each provided with a second through hole (19, 19') corresponding in position to a fingertip of an index finger of the four closely-aligned fingers, and a third through hole (20, 20') corresponding in position to a wrist of the right hand in a manner that, the second through holes (19, 19') are aligned with each other, and the third through holes (20, 20') are aligned with each other;

wherein the upper connecting moving piece (15) is provided with a bullet feeding opening (23) corresponding in position to one of the launching tubes (9), allowing a flare (58) to be placed in each of the launching tubes (9) via the bullet feeding opening (23) and a recessed portion (24) of the upper connecting moving piece (15), and the recessed portion (24) further acts as an exit for launching the flare (58);

wherein the lower connecting moving piece (16) is provided with a recessed portion (24') corresponding in position to the recessed portion (24) of the upper connecting moving piece (15), allowing a tail flame to pass through the recessed portion (24') of the lower connecting moving piece (16) when the flare (58) is launched;

wherein the upper and lower connecting moving pieces (15, 16) are each provided with a screw hole group (25, 25') and a spring fixing end (28, 28') at the wrist, the spring fixing ends (28, 28') protruding away from the upper and lower fixing pieces (10, 10') respectively;

a first tenon (26) and a first spring (27), wherein a screw hole of the screw hole group (25) of the upper connecting moving piece (15) is used to fasten the first tenon (26) and the first spring (27) in a manner that, the first spring (27) is interposed between the upper connecting moving piece (15) and the first tenon (26), allowing the first tenon (26) to be hooked to one of the recessed hooks (12) of the upper fixing piece (10);

a second tenon (26') and a second spring (27'), wherein a screw hole of the screw hole group (25') of the lower connecting moving piece (16) is used to fasten the second tenon (26') and the second spring (27') in a manner that, the second spring (27') is interposed between the lower connecting moving piece (16) and the second tenon (26'), allowing the second tenon (26') to be hooked to one of the recessed hooks (12') of the lower fixing piece (10');

a lighting device formed of an arc-shaped pulling handle (29) and a friction piece (30), wherein the friction piece (30) is located within the pulling handle (29) with a recessed side of the friction piece (30) facing the friction lighting openings (14) of the launching tubes (9), and a metal mesh (31) is formed on the recessed side of the friction piece (30); wherein one end of the pulling handle (29) is provided with an outwardly-protruding pulling tab (5), and one end of the friction piece (30) is provided with a sleeve tube (32) aiming at a pair of first apertures (33) formed at the other end of the pulling handle (29);

wherein the second through holes (19, 19') of the upper and lower connecting moving pieces (16, 15), the pair of first apertures (33) of the pulling handle (29), and the sleeve tube (32) are aligned with each other; wherein a pair of second apertures (34) at the end with the pulling tab (5) of the pulling handle (29), and the third through holes (20, 20') of the upper and lower connecting moving pieces (15, 16) are aligned with each other;

a first supporting pole (21) passing through the second through holes (19, 19') of the upper and lower connecting moving pieces (15, 16), the pair of first apertures (33) of the pulling handle (29), and the sleeve tube (32), so as to fasten the upper and lower connecting moving pieces (15, 16), the pulling handle (29) and the sleeve tube (32) together;

a second supporting pole (22) passing through the third through holes (20, 20') of the upper and lower connecting moving pieces (15, 16), and the pair of second apertures (34) of the pulling handle (29), so as to further secure fastening of the upper and lower connecting moving pieces (15, 16), and the pulling handle (29) together;

an upper uniting piece (35) located above the upper connecting moving piece (15), and formed with a centrally-situated aperture (37) corresponding in position to the centrally-situated through hole (11) of the upper fixing piece (10);

wherein the upper uniting piece (35) is formed with a plurality of launching openings (51) corresponding in position to the launching tubes (9), and the upper uniting piece (35) is provided with an upper screw-hole stand (53) that is integrally formed with a plurality of screw holes and adapted to be flush with the upper connecting moving piece (15);

wherein the upper uniting piece (35) is formed at a periphery thereof with a recessed arc portion (56), allowing the spring fixing end (28) of the upper connecting moving piece (15) to be exposed to the recessed arc portion (56) and move around within the recessed arc portion (56);

a lower uniting piece (36) located under the lower connecting moving piece (16), and formed with a centrally-situated aperture (37') corresponding in position to centrally-situated through hole (11') of the lower fixing piece (10') and the lower uniting piece (36) is provided with an opening (52) corresponding in position to the recessed portion (24') of the lower connecting moving piece (16), allowing the tail flame to pass through the opening (52) of the lower uniting piece (36) when the flare (58) is launched;

wherein the lower uniting piece (36) is provided with a lower screw-hole stand (53') that is integrally formed with a plurality of screw holes and adapted to be flush with the lower connecting moving piece (16);

wherein the lower uniting piece (36) is formed at a periphery thereof with a recessed arc portion (56'), allowing the spring fixing end (28') of the lower connecting moving piece (16) to be exposed to the recessed arc portion (56') and to move around within the recessed arc portion (56');

an upper spring holder portion (47) fixed on the upper uniting piece (35), wherein one end of the upper spring holder portion (47) is of a ring shape to be aligned with the centrally-situated aperture (37) of the upper uniting piece (35), and the other end of the upper spring holder portion (47) is hooked to the spring fixing end (28) of the upper connecting moving piece (15);

a lower spring holder portion (48) fixed to the lower uniting piece (36), wherein one end of the lower spring holder portion (48) is of a ring shape to be aligned with the centrally-situated aperture (37') of the lower uniting piece (36), and the other end of the lower spring holder portion (48) is hooked to the spring fixing end (28') of the lower connecting moving piece (16);

a third tenon (54) and a third spring (55), wherein one of the screw holes from the upper screw-hole stand (53) is used to fasten the third tenon (54) and the third spring (55) in a manner that, the third spring (55) is interposed between the upper screw-hole stand (53) and the third tenon (54), allowing the third tenon (54) to be hooked to one of the recessed hooks (12) of the upper fixing piece (10);

a fourth tenon (54') and a fourth spring (55'), wherein one of the screw holes from the lower screw-hole stand (53') is used to fasten the fourth tenon (54') and the fourth spring (55') in a manner that, the fourth spring (55') is interposed between the lower screw-hole stand (53') and the fourth tenon (54'), allowing the fourth tenon (54') to be hooked to one of the recessed hooks (12') of the lower fixing piece (10');

a third supporting pole (18) passing through the ring-shaped ends of the upper and lower spring holder portions (47, 48), the centrally-situated apertures (37, 37') of the upper and lower uniting pieces (35, 36), the first through holes (17, 17') of the upper and lower connecting moving pieces (15, 16), and the centrally-situated through holes (11, 11') of the upper and lower fixing pieces (10 10'), so as to fasten the upper and lower spring holder portions (47, 48), the upper and lower uniting pieces (35, 36), the upper and lower connecting moving pieces (15, 16), and the upper and lower fixing pieces (10, 10') together to form an assembled structure;

a hollow cylinder (3) for receiving the assembled structure therein, with the upper and lower uniting pieces (35, 36) being engaged with ends of the hollow cylinder (3), wherein the hollow cylinder (3) is provided with an outwardly-protruding supporting member (4) on an outer surface thereof, and an opening (6) penetrating through a wall of the hollow cylinder (3), for allowing the pulling tab (5) to pass through the opening (6); and a lid (2) for sealing the end, engaged with the upper uniting piece (35), of the hollow cylinder (3), the lid (2) being formed with a launching aperture (7) corresponding in position to one of the launching openings (51) and of the launching tubes (9), whereby the flare (58) received in the launching tube (9) is capable of being launched through the launching opening (51) and the launching aperture (7).

2. The emergency rescue device according to claim 1, wherein a slide groove (13) is formed on each of the launching tubes (9) longitudinally, and extends from the friction lighting opening (14) to reach the upper and lower fixing pieces (10, 10') respectively.

3. The emergency rescue device according to claim 1, wherein between the launching tubes (9) are provided a plurality of reinforcing pieces for enhancing the uniting of the plurality of launching tubes (9).

4. The emergency rescue device according to claim 1, wherein the recessed hooks (12) of the upper fixing piece (10) are symmetrically disposed with respect to the recessed hooks (12') of the lower fixing piece (10').

5. The emergency rescue device according to claim 1, wherein between the upper connecting moving piece (15) and the upper fixing piece (10) is provided an upper washer (39) formed with a centrally-situated through hole (40), and between the lower connecting moving piece (16) and the lower fixing piece (10') is provided a lower washer (39') formed with a centrally-situated through hole (40'), allowing the centrally-situated through hole (40) of the upper washer (39) and the centrally-situated through hole (40) of the lower washer (39') to be passed through by the third supporting pole (18).

6. The emergency rescue device according to claim 1, wherein the lower connecting moving piece (16) is provided with an opening (23') corresponding in position to the bullet feeding opening (23) of the upper connecting moving piece (15).

7. The emergency rescue device according to claim 1, wherein the screw hole groups (25, 25') of the upper and lower connecting moving pieces (15, 16) are symmetrically positioned with respect to each other, and the spring fixing ends (28, 28') of the upper and lower connecting moving pieces (15, 16) are symmetrically positioned with respect to each other.

8. The emergency rescue device according to claim 1, wherein both ends of the friction piece (30) are each provided with the sleeve tube (32), allowing the first supporting pole (21) and the second supporting pole (22) to pass through the sleeve tubes (32) respectively.

9. The emergency rescue device according to claim 1, wherein the width of the friction piece (30) is sufficient only to slidingly rub lighting powders of the flare (58) to be launched.

10. The emergency rescue device according to claim 1, wherein both ends of the third supporting pole (18) are respectively fixed with washers (43, 44) and fastened with nuts (45, 46).

11. The emergency rescue device according to claim 1, wherein a diameter of each of the launching openings (51) of the upper uniting piece (35) is larger than that of each of the launching tubes (9).

12. The emergency rescue device according to claim 1, wherein a diameter of the launching aperture (7) on the lid (2) is larger than that of each of the launching openings (51) on the upper uniting piece (35).

13. The emergency rescue device according to claim 1, wherein a diameter of the opening (52) on the lower uniting piece (36) is smaller than that of each of the launching tubes (9).

14. The emergency rescue device according to claim 1, wherein each of the upper and lower uniting pieces (35, 36) is provided with a flange (57, 57') at a position other than the recessed arc portion (56, 56') on the periphery of each of the upper and lower uniting pieces (35, 36).

15. The emergency rescue device according to claim 1, wherein the hollow cylinder (3) may be formed of two semi-cylinder halves, one of which is provided with the opening (6), allowing the pulling tab (5) to pass through the opening (6).

16. The emergency rescue device according to claim 1, wherein the supporting member (4) is vertically attached to the hollow cylinder (3).

17. The emergency rescue device according to claim 1, wherein the supporting member (4) is formed in a shape of a handle.

18. The emergency rescue device according to claim 1, wherein the lid (2) is fastened to the hollow cylinder (3).

19. A flare used in the emergency rescue device of claim 1 comprising: an upper end loaded with signal powders (59); a middle section loaded with pushing powders (60); and a lower end loaded with lighting powders (61), allowing the lighting powders (61) to be partially exposed to outside of the flare, wherein when the flare is placed in each of the launching tubes (9), the lighting powders (61) are at the same height as the metal mesh (31), such that the metal mesh (31) is capable of being turned to rub the lighting powders (61).

20. The flare according to claim 19, wherein a tail wing (62) is provided at the lower end of the flare.

21. The flare according to claim 19, wherein the lighting powders (61) are exposed to the friction lighting opening (14) of each of the launching tubes (9).

* * * * *